US006131212A

United States Patent [19]

Lang

[11] Patent Number: 6,131,212

[45] Date of Patent: Oct. 17, 2000

[54] EXTENDIBLE AND RETRACTABLE SPA JET WITH AIR/WATER VENTURI

[76] Inventor: Harold Lang, 8027 Twin Hills, Houston, Tex. 77071

[21] Appl. No.: 09/330,874

[22] Filed: Jun. 11, 1999

Related U.S. Application Data

[60] Provisional application No. 60/089,205, Jun. 12, 1998.

[51] Int. Cl.[7] ..... F04H 4/00; A61H 33/04

[52] U.S. Cl. ..... 4/541.6; 4/541.4; 239/281

[58] Field of Search ..... 4/541.1–541.6, 4/492; 239/280, 280.5, 281

[56] References Cited

U.S. PATENT DOCUMENTS

| | | | |
|---|---|---|---|
| 3,717,142 | 2/1973 | Mickelson | 4/541.3 |
| 4,313,432 | 2/1982 | Sievers | 4/541.3 |
| 4,430,762 | 2/1984 | Marshall | 4/541.4 |
| 4,458,676 | 7/1984 | Pileggi | 4/541.3 |
| 4,640,462 | 2/1987 | Stearns, III | 239/383 |
| 5,027,450 | 7/1991 | Lang | 4/541.6 |
| 5,093,942 | 3/1992 | Lang | 4/541.6 |
| 5,848,444 | 12/1998 | Christopherson | 4/541.1 |
| 5,878,446 | 3/1999 | McCann | 4/541.6 |

FOREIGN PATENT DOCUMENTS

| | | | |
|---|---|---|---|
| 3020015 | 1/1988 | United Kingdom | 4/541.3 |

*Primary Examiner*—Charles R. Eloshway
*Attorney, Agent, or Firm*—Kenneth A. Roddy

[57] ABSTRACT

An extendible and retractable spa jet having an air/water venturi resides in the side wall of a tub or spa in a retracted position and is operated by the existing pressurized water supply to produce a turbulent aerated stream of water and air bubbles. In the retracted position it serves as a conventional fixed air/water jet. When desired, it may be extended outwardly from the side wall of the enclosure and used as a hand-held massage device to achieve concentrated, intensified massaging action at localized areas of the body not possible with fixed spa jets.

18 Claims, 5 Drawing Sheets

AIR
CV
CLOSED
OPEN
WATER
10
11
12
13
14
15
16
17
18
19
20
21
22
23
24
25
26
27
28
29
30
31
32
33
34
35
36
37
38
39
40
41
42
43
44
45
46
47
S

10A
AIR
AIR
AIR

EXTENDIBLE AND RETRACTABLE SPA JET WITH AIR/WATER VENTURI

CROSS REFERENCE TO RELATED APPLICATION

This application claims priority of U.S. Provisional application Ser. No. 60/089,205, filed Jun. 12, 1998.

BACKGROUND OF THE INVENTION

1. Field of the Invention

This invention relates generally to water massage devices, and more particularly to an extendible and retractable spa jet having an air/water venturi operated by the existing pressurized water supply to produce a turbulent aerated stream of water and air bubbles which resides in the side wall of a tub or spa in a retracted position may be extended outwardly therefrom to be used as a hand-held massage device.

2. Brief Description of the Prior Art

Hot tubs and spas are well known for injecting aerated streams of water that have a therapeutic massaging effect on the body of the occupant. The therapeutic action of the tubs or spas is achieved by the vibrating action of bubbles and forceful circulation of water produced by jet nozzles positioned in the side walls of the spa or tub. However, the location of these jets allows the occupant to juxtapose primarily the back of the neck, shoulders, and back to the jets and, for the most part makes it impossible to achieve concentrated, intensified massaging action at other localized areas of the body.

Hand-held water sprayer heads and fluid powered vibrating heads which connect to faucets of household water systems are also known, but they are not particularly suited for operation or use in a submerged body of water. There are several patents which disclose various massage devices for use in spas or hot tubs.

Sievers, U.S. Pat. No. 4,313,432 discloses a water driven personal massager for use in spas, hot tubs and the like which is connected to and driven vibrationally by the pressurized water supply of the spa or tub. The device comprises a conduit for connection to the pressurized water supply, a nozzle to direct the pressurized water across an eccentrically weighted turbine or waffle plate within a hand holdable massager head.

Marshall, U.S. Pat. No. 4,430,762 discloses an aquassage apparatus comprising a length of perforated bendable tubing having suction cups secured to the bottom which is installed in conventional bath tubs. The exhaust port of a vacuum cleaner is connected at one end of the tubing and controlled by a valve to agitate the water in the tub.

Pileggi, U.S. Pat. No. 4,458,676 discloses a portable hand held massager in combination with a spa. The massager has a fluid motor that is mechanically connected to a reciprocating massage pad. The fluid motor is detachably connected to the pressurized fluid system of the spa, and has a sleeve adapter to attach to a jet nozzle in the wall of the spa with a flexible hose leading to the motor of the massage unit.

Stearns, III, U.S. Pat. No. 4,640,462 discloses a handheld water driven shower massager which includes a housing having an internally disposed rotatable nozzle which is caused to rotate by the high velocity discharge of water from the nozzle. An oscillating vibrational motion is applied to the entire device by eccentrically weighting the discharge nozzle, and provides a massaging effect when pressed against the body of the user. When held away from the user, the unit functions as a source of water spray for cleansing.

Karp, British Patent 766,508 discloses a reel unit for use with a bathroom fixture having a hot and cold water supply. The reel includes a valve and mixing chamber for regulating the water temperature, and a hose mounted on the reel and connected with the mixing chamber for drawing the mixed water from the chamber when the hose is extended.

My previous patents, U.S. Pat. Nos. 5,027,450 and 5,093,942, which are hereby incorporated herein by reference, are extendible and retractable spa jets that are mounted on retractable reels and may be extended outwardly from the side wall of the enclosure and used as a hand-held massage devices.

The present invention is distinguished over the prior art in general, and these patents in particular by an extendible and retractable air/water spa jet having an air/water venturi which is operated by the existing pressurized water supply to produce a turbulent aerated stream of water and air bubbles. In the retracted position it serves as a conventional fixed air/water jet. When desired, it may be extended outwardly from the side wall of the enclosure and used as a hand-held massage device to achieve concentrated, intensified massaging action at localized areas of the body not possible with fixed spa jets.

SUMMARY OF THE INVENTION

It is therefore an object of the present invention to provide an extendible and retractable air/water spa jet which in the retracted position resides in the side wall of a spa or tub to serve as a conventional fixed air/water jet and may also be extended outwardly therefrom to be used as a hand-held massage device.

It is another object of this invention to provide an extendible and retractable air/water spa jet which is operated by the existing pressurized water supply of a spa or tub to produce a turbulent aerated stream of water and air bubbles.

Another object of this invention is to provide a extendible and retractable air/water spa jet which is easily installed in the side wall of a spa or tub and connected to the existing pressurized water supply by simple connections.

A further object of this invention is to provide an extendible and retractable air/water spa jet which makes it possible to achieve concentrated, intensified massaging action at localized areas of the body not possible with fixed spa jets.

A still further object of this invention is to provide an extendible and retractable spa jet which is simple in design and construction, economical to manufacture, and rugged and durable in use.

Other objects of the invention will become apparent from time to time throughout the specification and claims as hereinafter related.

The above noted objects and other objects of the invention are accomplished by an extendible and retractable air/water spa jet having an air/water venturi which is operated by the existing pressurized water supply to produce a turbulent aerated stream of water and air bubbles. In the retracted position it serves as a conventional fixed air/water jet. When desired, it may be extended outwardly from the side wall of the enclosure and used as a hand-held massage device to achieve concentrated, intensified massaging action at localized areas of the body not possible with fixed spa jets.

DESCRIPTION OF THE PREFERRED EMBODIMENTS

The present extendible and retractable spa jet is installed in spas or tubs of conventional construction having openings in the side wall to receive conventional fluid jet nozzles which are connected with one or more fluid distribution conduits, and having a conventional water circulation system. The typical spa or tub water circulation system includes a return line from a drain or outlet of the tub enclosure that leads to a pump. The pump discharge is connected to the water distribution conduit which is in open communication with each of the plurality of conventional jet nozzles. It should be understood that the spa or tub may utilize one or more extendible and retractable jets, as described hereinafter, in combination with conventional fixed jets or may utilize all extendible and retractable jets.

Figures 1, 2:
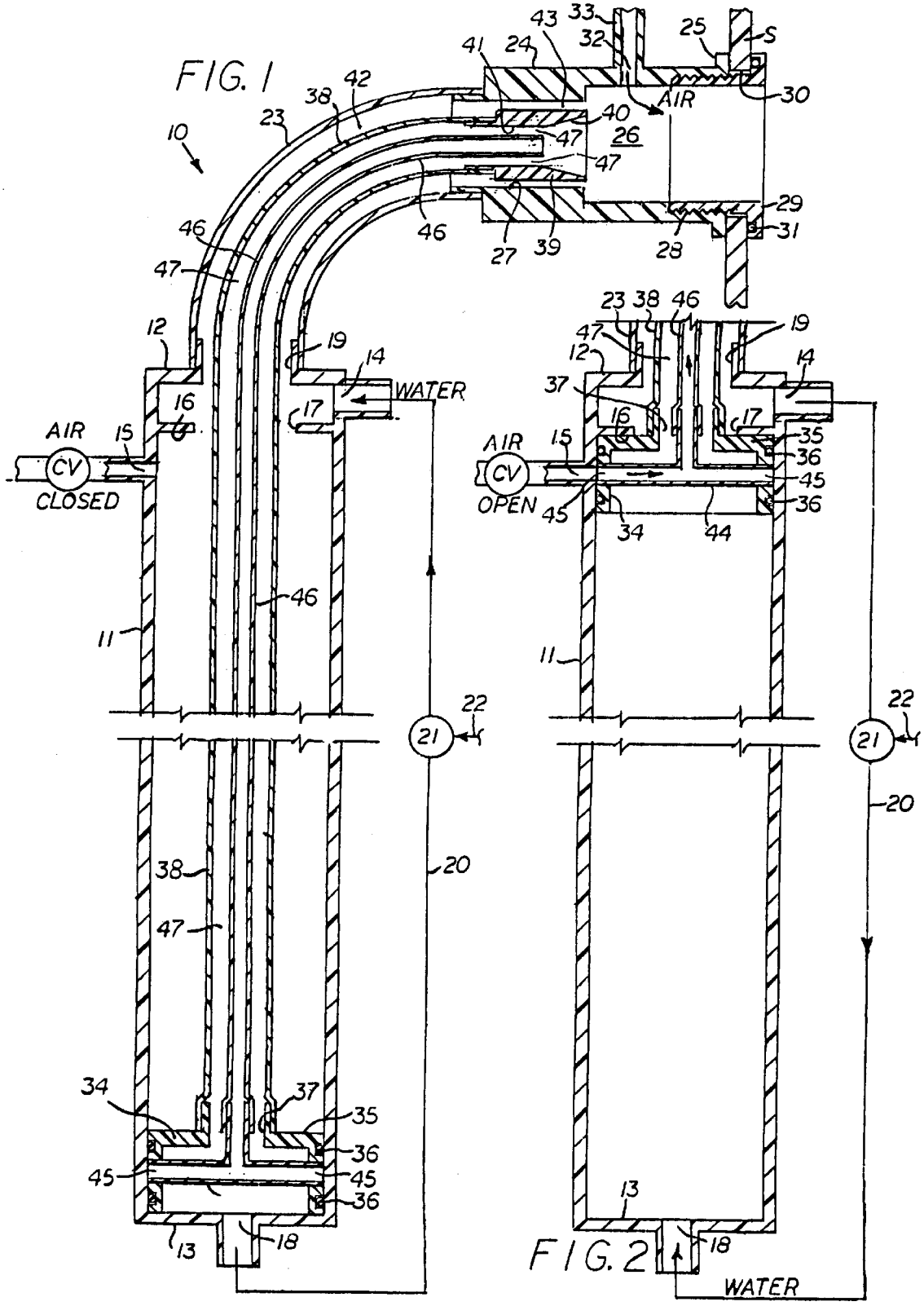
FIG. 1 is a longitudinal cross section of the extendible and retractable air/water spa jet in accordance with the present invention, shown in a retracted position.
FIG. 2 is a longitudinal cross section of the lower portion of the extendible and retractable air/water spa jet of FIG. 1, showing the piston in an uppermost position.
Figure 3:
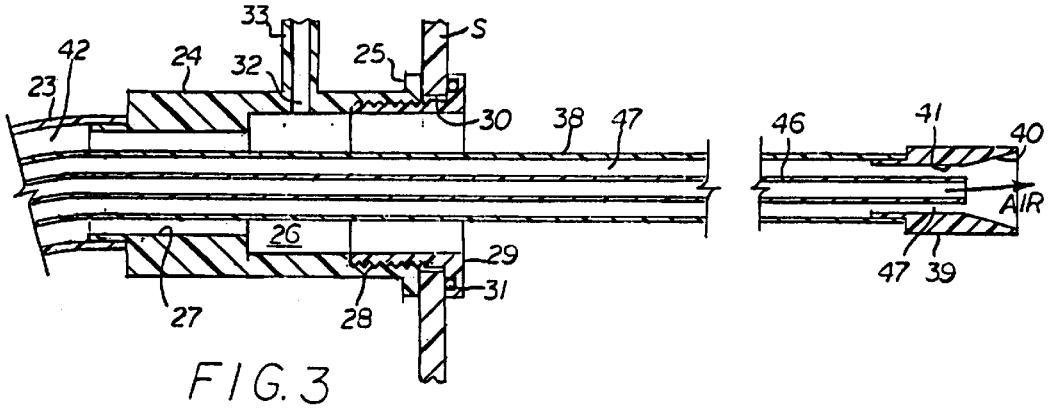
FIG. 3 is a longitudinal cross section of the upper portion of the extendible and retractable air/water spa jet of FIG. 1, showing the air/water nozzle in an extended position.

Referring to the drawings by numerals of reference there is shown in FIGS. 1, 2 and 3, a preferred extendible and retractable spa jet 10 attached to the side wall S of a spa or tub such as described above. The extendible and retractable spa jet 10 has an elongate hollow tubular outer housing 11, which may be made of flexible tubing, and is enclosed at each end by a top end wall 12 and a bottom end wall 13. A first water port 14 extends through the side wall of the outer housing 11 at its upper end. A first air inlet 15 extends through the side wall of the outer housing 11 at its upper end spaced a distance beneath the water port 14. A check valve CV is connected to the air inlet 15. The interior of the outer housing 11 is provided with a stop shoulder 16 disposed between the water port 14 and the air inlet 15 which extends radially inward from the side wall of the outer housing and has a central bore 17 extending therethrough. A second water port 18 extends through the bottom end wall 13 of the outer housing 11 at its bottom end. A water outlet 19 extends through the top end wall 12 of the outer housing 11 at its top end.

The first and second water ports 14 and 18 are joined together by conduit 20 and a two-way valve 21 installed in the conduit 20. The inlet of the two-way valve 21 is connected by conduit 22 to the existing water distribution conduit through which water is pumped to the water jet nozzles. The two-way valve 21 selectively directs water either into the first water port 14 at the upper end of the outer housing 11 or into the second water port 18 at the bottom of the outer housing.

An outer or first water outlet conduit 23, preferably formed of flexible tubing, is connected at one end to the water outlet 19 and its opposite end is connected to the back end of a generally cylindrical member 24 having a radial flange 25 at its front end and a cylindrical cavity 26 which extends inwardly from the front end and terminates in a reduced diameter bore 27. The forward end of the cavity 26 is provided with internal threads 28. The cylindrical member 24 is secured to the side wall S of the tub or spa by a hollow cylindrical trim ring 29 having external threads and a radial flange which extends through an aperture 30 in the side wall S of the tub or spa and is threadedly engaged in the threads 28. An elastomeric seal 31 may be installed between the radial flange of the trim ring 29 and the side wall of the tub or spa. The conduit 23 forms a smooth curve between the outer housing 11 and the cylindrical member 24.

A second air inlet 32 extends through the side wall of cylindrical member 24 in fluid communication with the cavity 26. A length of conduit 33 has one end connected to the second air inlet 32 and its opposite end extends upwardly therefrom and terminates above the normal water level of the tub or spa.

Figure 2A:
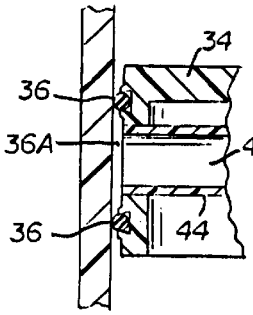
FIG. 2A is an enlarged partial cross section through the side wall of the piston showing the annular air space.

A hollow cylindrical piston member 34 having a top wall 35 is slidably received in the interior of the outer housing 11 and has seal elements 36 on its circumference which form a sliding fluid seal against the interior of the side wall of the housing 11 and define an annular air space 36A around the piston (FIG. 2A) . A water port 37 extends through the top wall 35 of the piston 34. An inner or second water outlet conduit 38, preferably formed of flexible tubing, connected at one end to the water port 37 extends upwardly through the interior of the outer or first conduit 23 following its curvature and its opposite end is connected to the back end of a nozzle 39 having a conical bore 40 at its front end which tapers inwardly from the front end and terminates in a reduced diameter bore 41, Conventional nozzles or spinner nozzles may be used on the water conduit.

The outer diameter of the inner or second conduit 38 is smaller than the interior diameter of the outer or first conduit 23 defining an annulus 42 therebetween. The length of the inner or second conduit 38 is sufficient to place the nozzle 39 within the reduced bore 27 of the cylindrical member 24 when the piston 34 is at its lowermost position (FIG. 1). The outer diameter of the nozzle 39 is smaller than the interior diameter of the reduced bore 27 of the cylindrical member 24 defining an annulus 43 therebetween.

An inverted tubular tee 44 is secured transversely across the interior of the piston 34 with its opposed ends 45 extending through the side wall of the piston between the O-ring seals 36 to serve as air inlets. An air tube 46, preferably formed of flexible tubing, is connected at one end to the outlet end of the tee 44 and extends upwardly through the interior of the inner or second conduit 38 following its curvature and its opposite end extends into the nozzle 39 and terminates at the approximate intersection of the conical bore 40 with the reduced diameter bore 41. The outer diameter of the air tube 46 is smaller than the interior diameter of the inner or second conduit 38 and the reduced bore 41 of the nozzle defining an annulus 47 therebetween.

As seen in FIG. 1, when the two-way valve 21 is turned to a first position, water is pumped through the conduit 20 into the first water port 14 at the upper end of the housing 11 and the piston 34 is forced downward through the water in the housing 11. Water beneath the piston 34 travels upward through the water port 37 of the piston, the annulus 42 between the outer or first conduit 23 and inner or second conduit 38, through the annulus 43 between the nozzle 39 and the reduced bore 27 of the cylindrical member 24, and into the tub or spa. The water pressure inside the housing closes the check valve CV connected to the first air inlet 15. The seal elements 36 on the piston 34 prevent water from entering the opposed ends 45 of the tee 44. When the piston 34 reaches the bottom wall 13 of the housing 11, the nozzle 39 is disposed within the reduced bore 27 of the cylindrical member 24 in a retracted position. As water fills the housing 11 it flows through the annulus between the outer or first conduit 23 and inner or second conduit 38 and the annulus 43 between the exterior of the nozzle 39 and the bore 27 of the cylindrical member 24, and is discharged into the tub or spa. As the water is discharged around the nozzle 39 and outwardly through the cylindrical member 24, air is drawn in through the second air inlet 32 due to the venturi effect and is mixed with the water being discharged to form a turbulent aerated stream of water and air bubbles.

As seen in FIG. 2, when it is desired to extend the nozzle 39, the two-way valve 21 is turned to a second position, and water is pumped through the conduit 20 into the second water port 18 at the bottom end of the housing 11 and flows through the interior of the piston 34, through the port 37 in its top wall, through the annulus 47 between the air tube 46 and inner or second conduit 38 and the air tube and 41 of the nozzle 39, outwardly through the conical bore 40 and is discharged into the tub or spa. This causes the piston 34 to move upwardly due to the water pressure acting on the top wall 35 of the piston 34 and the restricted passageway between the air tube 46 and the bore 41 of the nozzle 39. Water also passes through the annulus 42 between outer or first conduit 23 and the inner or second conduit 38 and the annulus between the exterior of the nozzle 39 and the bore 27 of the cylindrical member 24 and into the tub or spa. As the piston 34 moves upwardly the nozzle 39 becomes extended outwardly from the cylindrical member 24 into the tub or spa (FIG. 3).

When the piston 34 reaches its uppermost position against the stop shoulder 16, the opposed ends 45 of the tee 44 are axially aligned with the first air inlet 15 and a circumferential air passageway is established between the seal elements 36 and through the tee 43, and the check valve CV connected to the first air inlet 15 opens. When the piston 34 is in the uppermost position against the stop shoulder 16, the piston shuts off flow through the annulus 42 between the outer or first conduit 23 and inner or second conduit 38, but water continues to flow through the annulus 47. As the water is discharged around the terminal end of the air tube 46 and outwardly through the bore 40 of the nozzle 39, air is drawn in through the opposed ends 45 of the tee 44, through the air tube 46 due to the venturi effect and is mixed with the water being discharged to form a turbulent aerated stream of water and air bubbles.

When the nozzle 39 is extended, it may be held by the hand of a user and used as a hand-held massage device to achieve concentrated, intensified massaging action at localized areas of the body not possible with fixed spa jets. In the retracted position, the nozzle 39 resides closely adjacent to the side wall of the tub or spa and serves as a fixed air/water jet.

Although the piston 34 has been shown with circumferential seal elements 36, it should be understood that, depending upon the materials of construction, the seals may be eliminated, and/or seals may be provided on the stop shoulder 16 to engage the piston in its uppermost position.

Figure 6:
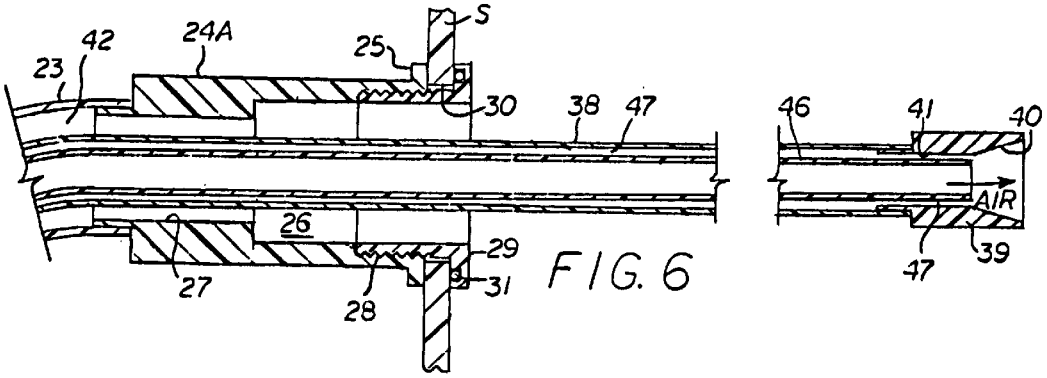
FIG. 6 is a longitudinal cross section of the upper portion of the extendible and retractable air/water spa jet of FIG. 4, showing the air/water nozzle in an extended position.
Figures 4, 5:
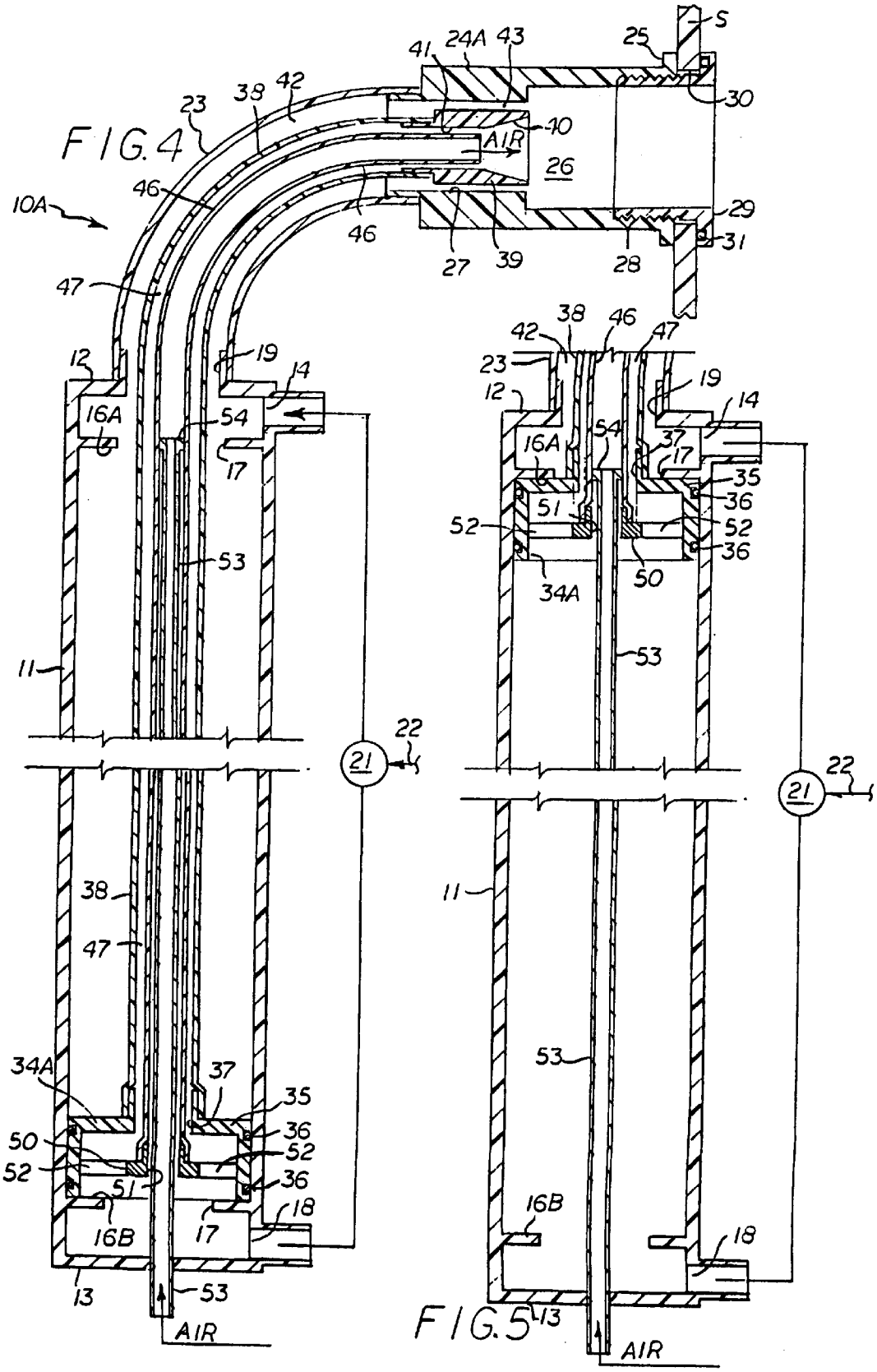
FIG. 4 is a longitudinal cross section of another embodiment of the air/water spa jet in accordance with the present invention, shown in a retracted position.
FIG. 5 is a longitudinal cross section of the lower portion of the extendible and retractable air/water spa jet of FIG. 4, showing the piston in an uppermost position.

Referring now to FIGS. 4, 5, and 6, there is shown a modification of the extendible and retractable spa jet 10A similar to that described above, but having a modified air supply arrangement. The extendible and retractable spa jet 10A has an elongate hollow tubular outer housing 11 enclosed at each end by a top end wall 12 and a bottom end wall 13. A first water port 14 extends through the side wall of the outer housing 11 near its upper end and a second water port 18 extends through the side wall near its bottom end.

The interior of the outer housing 11 is provided with an upper stop shoulder 16A disposed beneath the water port 14 and a lower stop shoulder 16B disposed above the water port 18. The stop shoulders 16A and 16B extend radially inward from the side wall of the outer housing and each has a central bore 17 extending therethrough. A water outlet 19 extends through the top end wall 12 of the outer housing 11 at its top end.

As with the previous embodiment, the first and second water ports 14 and 18 are joined together by conduit 20 and a two-way valve 21 installed in the conduit 20. The inlet of the two-way valve 21 is connected by conduit 22 to the existing water distribution conduit through which water is pumped to the water jet nozzles. The two-way valve 21 selectively directs water either into the first water port 14 at the upper end of the outer housing 11 or into the second water port 18 at the lower end of the outer housing.

An outer or first conduit 23, preferably formed of flexible tubing, is connected at one end to the water outlet 19 and its opposite end is connected to the back end of a generally cylindrical member 24A having a radial flange 25 at its front end and a cylindrical cavity 26 which extends inwardly from the front end and terminates in a reduced diameter bore 27. The forward end of the cavity 26 is provided with internal threads 28. The cylindrical member 24A is secured to the side wall S of the tub or spa by a hollow cylindrical trim ring 29 having external threads and a radial flange which extends through an aperture 30 in the side wall of the tub or spa and is threadedly engaged in the threads 28. An elastomeric seal 31 may be installed between the radial flange of the trim ring 29 and the side wall of the tub or spa. The conduit 23 forms a smooth curve between the outer housing 11 and the cylindrical member 24A. In this embodiment there is no second air inlet connected to the cylindrical member 24A.

A hollow cylindrical piston member 34A having a top wall 35 is slidably received in the interior of the outer housing 11 and has seal elements 36 on its circumference which form a sliding fluid seal against the interior of the side wall of the housing 11. A water port 37 extends through the top wall 35 of the piston 34A. An inner or second water outlet conduit 38, preferably formed of flexible tubing, is connected at one end to the water port 37 and extends upwardly through the interior of the outer flexible tubing 23 following its curvature, and its opposite end is connected to the back end of a tubular nozzle 39 having a conical bore 40 at its front end which tapers inwardly from the front end and terminates in a reduced diameter bore 41.

The outer diameter of the inner or second conduit 38 is smaller than the interior diameter of the outer or first conduit 23 defining an annulus 42 therebetween. The length of the conduit 38 is sufficient to place the nozzle 39 within the reduced bore 27 of the cylindrical member 24A when the piston 34A is at its lowermost position. The outer diameter of the nozzle 39 is smaller than the interior diameter of the bore 27 of the cylindrical member 24A defining an annulus 43 therebetween.

A central spider ring 50 having a central bore 51 is secured in the interior of the piston 34A by radially extending arms 52 having their outer ends secured to the interior of the piston side wall. An air tube 46, preferably formed of flexible tubing, is connected at its lower end to the central ring 50 of the spider and extends upwardly through the water port 37 in the top wall 35 of the piston 34A and through the interior of the inner or second conduit 38 following its curvature and its opposite end extends into the nozzle 39 and terminates at the approximate intersection of the conical bore 40 with the reduced diameter bore 41. The outer diameter of the air tube 46 is smaller than the interior diameter of the inner or second conduit 38 and the bore 41 of the nozzle defining an annulus 47 therebetween.

In this embodiment air is conducted into the air tube 46 through a stationary air conduit 53 which may be flexible or rigid. The lower portion of the air conduit 53 extends through the bottom wall 13 of the outer housing 11 and is provided with an appropriate water seal and extends upwardly slidably through the central bore 51 of the spider ring 50 and through the center of the air tube 46 and is provided with a radial flange at its top end which forms a sliding water-tight seal against the interior of the air tube 46. The piston 34A, the air tube 46, and the inner or second conduit 38 move with the piston 34A.

As seen in FIG. 4, when the two-way valve 21 is turned to a first position, water is pumped through the conduit 20 into the first water port 14 at the upper end of the housing 11 and the piston 34A is forced downward through the water in the housing 11. Water beneath the piston 34A travels upward through the water port 37 of the piston, the annulus 42 between the outer or first conduit 23 and inner or second conduit 38, through the annulus 43 between the nozzle 39 and the bore 27 of the cylindrical member 24, and into the tub or spa. The radial flange 54 of the air conduit 53 prevents water from flowing through the air tube 46. When the piston 34A reaches the bottom stop shoulder 16B, the nozzle 39 is disposed within the reduced bore 27 of the cylindrical member 24A in a retracted position. As water fills the housing 11 it flows through the annulus 42 between the outer or first conduit 23 and inner or second conduit 38 and the annulus 43 between the exterior of the nozzle 39 and the reduced bore 27 of the cylindrical member 24A, and is discharged into the tub or spa. As the water is discharged around the nozzle 39 and outwardly through the cylindrical member 24A, air is drawn in through the air conduit 53 and air tube 46 due to the venturi effect and is mixed with the water being discharged to form a turbulent aerated stream of water and air bubbles.

As seen in FIG. 5, when it is desired to extend the nozzle 39, the two-way valve 21 is turned to a second position, and water is pumped through the conduit 20 into the second water port 18 near the bottom end of the housing 11 and flows through the interior of the piston 34A, through the port 37 in its top wall, through the annulus 47 between the air tube 46 and inner or second conduit 38 and the air tube and bore 41 of the nozzle 39, outwardly through the nozzle and is discharged into the tub or spa. This causes the piston 34 to move upwardly due to the water pressure acting on the top wall 35 of the piston 34A and the restricted passageway between the air tube 46 and the bore 41 of the nozzle 39. Water also passes through the annulus 42 between outer or first conduit 23 and the inner or second conduit 38 and the annulus between the exterior of the nozzle 39 and the bore 27 of the cylindrical member 24A and into the tub or spa. As the piston 34A moves upwardly the nozzle 39 becomes extended outwardly from the cylindrical member 24A into the tub or spa (FIG. 6).

When the piston 34A reaches its uppermost position against the upper stop shoulder 16A it shuts off flow through the annulus 42, but water continues to flow through the annulus 47. As the water is discharged around the terminal end of the air tube 46 and outwardly through the bore 40 of the nozzle 39, air is drawn in through the conduit 53 and the air tube 46 due to the venturi effect and is mixed with the water being discharged to form a turbulent aerated stream of water and air bubbles.

As with the previous embodiment, when the nozzle 39 is extended, it may be held by the hand of a user and used as a hand-held massage device to achieve concentrated, intensified massaging action at localized areas of the body not possible with fixed spa jets. In the retracted position, the nozzle resides closely adjacent to the side wall of the tub or spa and serves as a fixed air/water jet.

Figure 7:
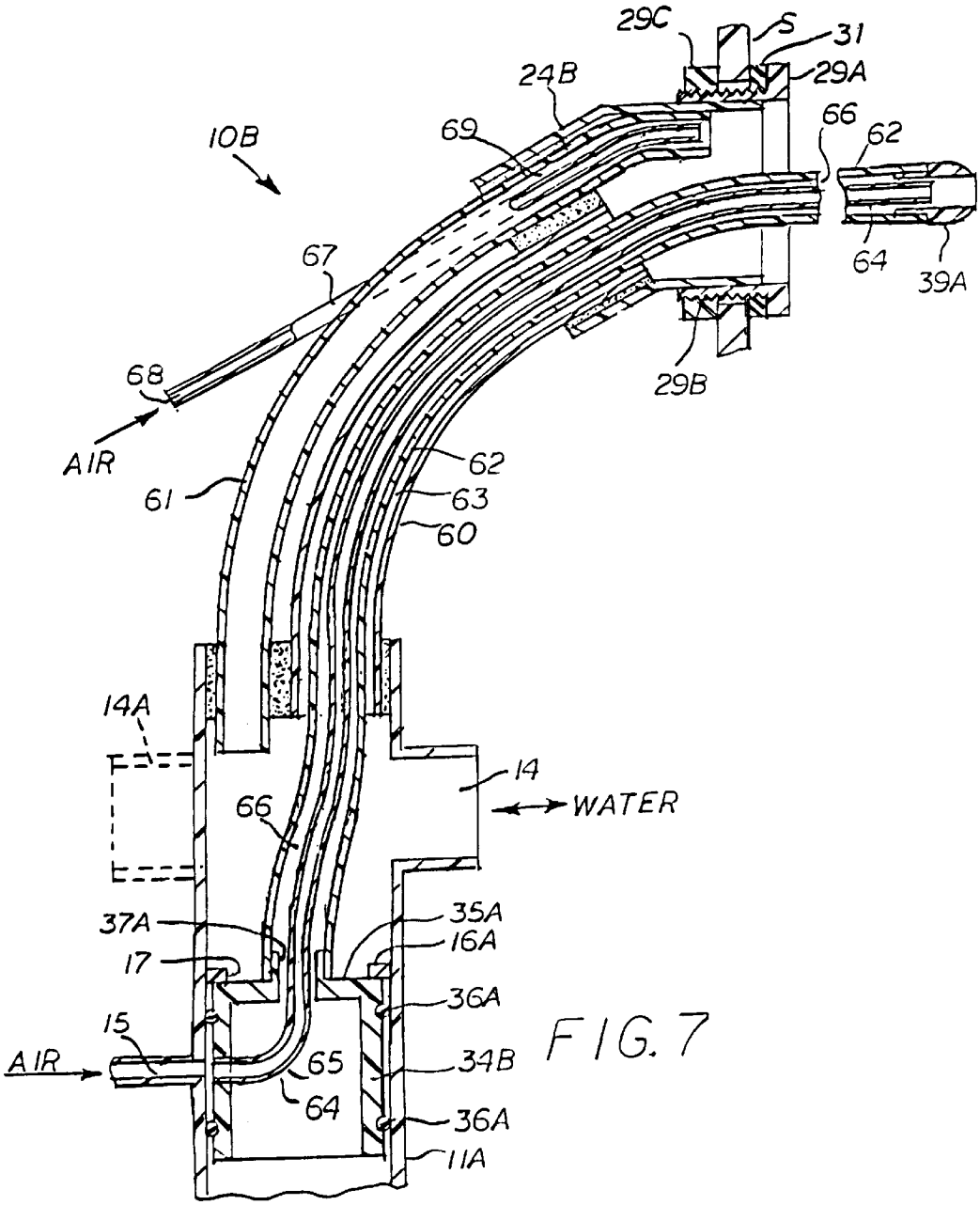
FIG. 7 is a longitudinal cross section of a modification of the upper portion of the extendible and retractable air/water spa jet shown with the piston in the upper position.

FIG. 7 shows a modified upper portion of the extendible and retractable spa jet 10B having second water conduit and a modified air supply arrangement shown with the piston 34B in the upper position. In this embodiment, the extendible and retractable spa jet 10B has an elongate hollow tubular outer housing 11A and upper and lower water ports similar to that previously described, but only the upper or first water port 14 is shown near its upper end. As described above with reference to the previous embodiments, the first and second water ports are joined together by conduit and a two-way valve installed in the conduit and the valve is connected to the existing water distribution conduit.

The interior of the outer housing 11A is provided with an upper stop shoulder 16A disposed beneath the water port 14. The stop shoulder 16A extends radially inward from the side wall of the outer housing and has a central bore 17 extending therethrough. An air inlet 15 extends radially through the side wall of the housing beneath the stop shoulder 16A which may be provided with a check valve allowing air to enter from the exterior when open, or connected to an air source.

An outer or first water outlet conduit 60, preferably formed of flexible tubing, has one end secured in the top end of the housing 11A above the water port 14 and its opposite end is secured in the back end of a hollow cylindrical member 24B. A water bypass conduit 61 preferably formed of flexible tubing is secured in the top end of the housing 11A above the water port 14 and its opposite end is secured in the back end of the hollow cylindrical member 24B. The ends of the conduits 60 and 61 are secured in the housing 11A and cylindrical member 24B by waterproof potting material, epoxy, or other suitable means.

The generally cylindrical member 24B has an angular configuration or elbow shape and a central cavity 26A. A trim ring 29A having a radial flange is engaged on the front end of the generally cylindrical member 24B and has exterior threads 29B. The cylindrical member 24B and trim ring 29A are secured to the side wall S of the tub or spa by a nut 29C engaged on the threads 29B. An elastomeric seal 31 is installed between the radial flange of the trim ring 29A and the side wall of the tub or spa. The conduits 60 and 61 form a smooth curve between the housing 11A and the cylindrical member 24B, facilitated by the angular shape of the cylindrical member.

The hollow cylindrical piston member 34B having a top wall 35A is slidably received in the interior of the outer housing 11A and has seals 36A on its circumference which form a sliding fluid seal against the interior of the side wall of the housing. A water port 37A extends through the top wall 35A of the piston 34B. An inner or second water outlet conduit 62, preferably formed of flexible tubing, is connected at one end to the piston water port 37A and extends upwardly through the interior of the outer or first conduit 60 following its curvature, and its opposite end is connected to the back end of a nozzle 39A. The outer diameter of the inner or second conduit 62 is smaller than the interior diameter of the outer or first conduit 60 defining an annulus 63 therebetween. The length of the inner or second conduit 62 is sufficient to place the nozzle 39A within the cavity 26A of the cylindrical member 24B when the piston 34B is at its lowermost position.

A first flexible air tube 64 having a central bore 65 is secured at its lower end through the side wall of the piston 34B and extends upwardly through the water port 37A in the top wall 35A of the piston and through the interior of the inner or second conduit 62 following its curvature and its opposite end extends into the nozzle 39A. The end of the air tube 64 extending through the side wall of the piston 34B is axially aligned with the air inlet 15 when the piston is in its uppermost position. The outer diameter of the flexible air tube 64 is smaller than the interior diameter of the inner or second conduit 62 and the bore of the nozzle defining an annulus 66 therebetween.

A second flexible air tube 67 having a central bore 68 has one end extending sealingly through the side wall of the water bypass conduit 61 near its end that is secured in the back end of the hollow cylindrical member 24B. The opposite or outer end of the second air tube 67 may be provided with a check valve allowing air to enter from the exterior when open, or connected to an air source. The outer diameter of the second flexible air tube 67 is smaller than the interior diameter of the water bypass conduit 61 defining an annulus 69 therebetween.

When water is directed through the water port 14 at the upper end of the housing 11A, the piston 34B is forced downward through the water in the housing. Water beneath the piston 34B travels upward through the water port 37A of the piston, the annulus 63 between the exterior of the first air tube 64 and the interior of the inner or second conduit 62, through the annulus 66 between the air tube 64 and nozzle 39A, and into the tub or spa. The communication between the air inlet 15 and the first air tube 64 is blocked off when the piston is in the lower position.

As the housing fills, water above the piston 34B is forced through the water bypass conduit 61, through the annulus 69 between the exterior of the second air tube 67 and the interior of the conduit 61, and discharged into the tub or spa. As the water is discharged through the bypass conduit 61 and annulus 69 around the second air tube 67 and outwardly through the cylindrical member 24B, air is drawn in through the second air tube 67 due to the venturi effect and is mixed with the water being discharged to form a turbulent aerated stream of water and air bubbles.

When water is directed into the housing 11A beneath the piston 34B, it flows through the interior of the piston, through the water port 37A in its top wall, through the annulus 66 between the exterior of the first air tube 64 and the interior of the inner or second conduit 62 and bore of the nozzle 39A, and is discharged into the tub or spa. This causes the piston 34B to move upwardly due to the water pressure acting on the piston 34A and the restricted water passageways between the conduits. As the piston 34B moves upwardly the nozzle 39A becomes extended outwardly from the cylindrical member 24B into the tub or spa.

When the piston 34B reaches its uppermost position against the upper stop shoulder 16A the end of the air tube 64 in the piston is in communication with the air inlet 15. As the water is discharged through the annulus 66 between the exterior of the air tube 64 and interior of the inner or second conduit 62 and bore of the nozzle 39A, air is drawn in through the first air tube 64 due to the venturi effect and is mixed with the water being discharged through the nozzle to form a turbulent aerated stream of water and air bubbles.

As with the previous embodiments, when the nozzle 39A is extended, it may be held by the hand of a user and used as a hand-held massage device to achieve concentrated, intensified massaging action at localized areas of the body not possible with fixed spa jets. In the retracted position, the nozzle resides closely adjacent to the side wall of the tub or spa and serves as a fixed air/water jet.

FIG. 7 also shows another modification wherein a secondary water port 14A (represented by dashed line) is provided through the side wall of the outer housing 11A above the upper piston stop shoulder 16A for connecting the housing to another spa jet. When the housing 11A is filled with water, the water is also conducted to the secondary spa jet through the port 14A. The secondary jet may be an existing conventional water jet nozzle or may be a retractable spa jet in accordance with one of the embodiments described previously.

Figure 8:
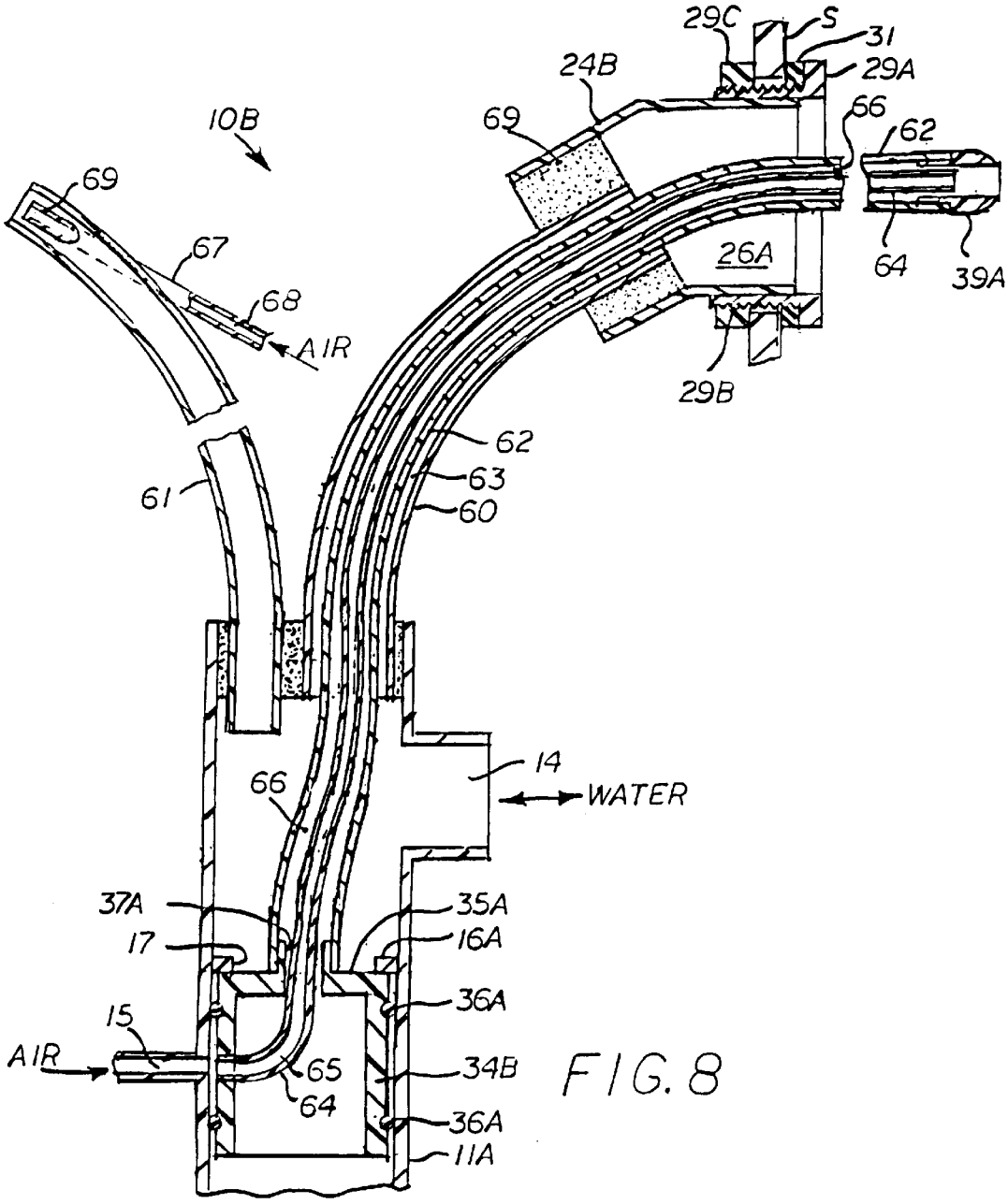
FIG. 8 is a longitudinal cross section of a modification of the upper portion of FIG. 7, showing the third water outlet conduit adapted to be connected to a secondary spa jet.

FIG. 8 shows another modification 10C of the embodiment described above in reference to FIG. 7 which is adapted to be connected with a secondary jet. In this modification, the water bypass conduit 61 is secured at one end in the top end of the housing 11A above the water port 14 as described previously. The free end of the conduit 61 may be connected to another spa jet a distance away from the housing 11A. When the housing 11A is filled with water, the water is also conducted to the secondary spa jet through the water bypass conduit 61. The free end of the conduit 61 may also be provided with a second flexible air tube 67 having a central bore 68 with one end extending sealingly through the side wall of the water bypass conduit, for creating a turbulent aerated stream of water and air bubbles, as described above.

Figure 9:
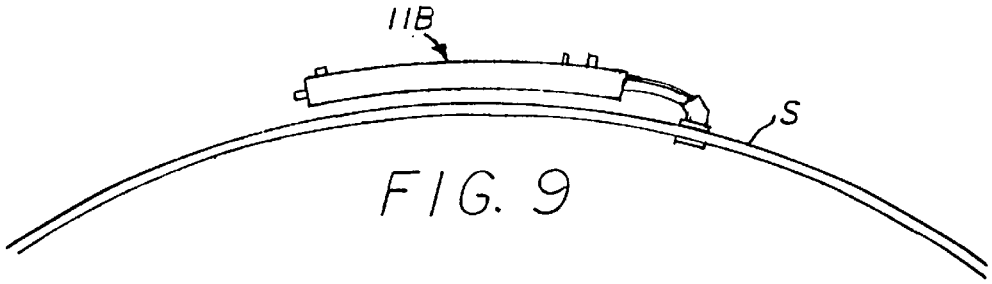
FIG. 9 shows somewhat schematically, a modification wherein the outer housing is formed of flexible tubing and can be bent or curved to generally follow the curvature of the side wall of the spa tub or enclosure.

FIG. 9 shows schematically a modification wherein the outer housing 11B is formed of flexible tubing and can be bent or curved to generally follow the curvature of the spa tub side wall S or to fit around corners to facilitate installation.

While this invention has been described fully and completely with special emphasis upon preferred embodiments, it should be understood that within the scope of the appended claims the invention may be practiced otherwise than as specifically described herein.

What is claimed is:

1. An extendible and retractable air/water jet apparatus for use in fluid containing enclosures which have at least one side wall and a pressurized water distribution system, the jet apparatus comprising:

an elongate housing having first and second ends, a hollow interior surrounded by a side wall, a first water outlet conduit at said first end adapted to be secured to the exterior of said enclosure side wall to place said housing interior in fluid communication with said enclosure interior, a first water port near said first end, and a second water port near said second end;

a piston slidably disposed within said elongate housing interior engaged in reciprocating relation with the interior of said housing side wall, and having a water passageway extending therethrough, said piston being movable between said housing first and second ends; and a second water outlet conduit slidably disposed inside said first water outlet conduit and connected at a first end in fluid communication with said piston water passageway;

a water discharge nozzle connected in fluid communication with a second end of said second water outlet conduit to move therewith, said second water outlet conduit having an outer diameter smaller than the interior diameter of said first water outlet conduit to define a water annulus therebetween; wherein when water under pressure fills said housing through said first water port, said piston is moved to a position near said housing second end, said second water outlet conduit and nozzle is retracted within said first water outlet conduit, and water flows through said water annulus and is discharged around said second water outlet conduit and nozzle into said enclosure; and when water under pressure fills said housing through said second water port, said piston is moved to a position near said housing first end, said second water outlet conduit and nozzle is extended outwardly relative to said first water outlet conduit, said piston closes off water flow through said water annulus, and water flows through said piston water passageway, through the interior of said second water outlet conduit and nozzle, and is discharged into said enclosure.

2. An extendible and retractable air/water jet apparatus according to claim 1, further comprising water diverting means connected between said first and said second water ports and adapted to be connected to said water distribution system for selectively conducting water into said housing interior through either one of said first and second water ports.

3. An extendible and retractable air/water jet apparatus according to claim 1, wherein said second water outlet conduit is formed of flexible tubing.

4. An extendible and retractable air/water jet apparatus according to claim 1, wherein said first and said second water outlet conduits are formed of flexible tubing.

5. An extendible and retractable air/water jet apparatus according to claim 1, wherein said housing is formed of flexible tubing.

6. An extendible and retractable air/water jet apparatus according to claim 1, further comprising:

an air inlet on said housing near its said first end for conducting air from the exterior of said housing into the interior thereof;

valve means connected with said air inlet for allowing passage of air only into said air inlet;

an air tube disposed generally concentrically within said second water outlet conduit to move therewith having a first end disposed adjacent to said nozzle and a second end extending through said piston with its interior in fluid communication with the exterior of said piston, said air tube having an outer diameter smaller than the interior diameter of said second water outlet conduit and said nozzle to define a second water annulus therebetween; wherein when water under pressure fills said housing through said first water port, said valve means closes, said piston is moved to a position near said housing second end, said second water outlet conduit, said nozzle and said air tube is retracted within said first water outlet conduit, water flows through said water annulus and is discharged around said second water outlet conduit and nozzle into said enclosure; and when water under pressure fills said housing through said second water port, said piston is moved to a position near said housing first end, said air tube second end is in fluid communication with said air inlet, said valve means opens, said second water outlet conduit, said nozzle and said air tube is extended outwardly relative to said first water outlet conduit, said piston closes off water flow through said water annulus, and water flows through said piston water passageway, through said second water annulus and is discharged around said air tube first end into said enclosure creating a venturi effect to draw ambient air through said air inlet, through said air tube and form a turbulent aerated stream of water and air bubbles.

7. An extendible and retractable air/water jet apparatus according to claim 6, further comprising:

a third water outlet conduit at said housing first end having a first end in fluid communication with said housing interior and a second end in fluid communication with said enclosure interior;

a second air tube having a first end disposed generally concentrically within one end of said third water outlet conduit and a second end extending outwardly of said third water outlet conduit, said air tube having an outer diameter smaller than the interior diameter of said third water outlet conduit to define a third water annulus therebetween;

second valve means connected with said second air tube for allowing passage of air only into said third air tube; wherein when water under pressure fills said housing through said first water port, said valve means closes, said piston is moved to a position near said housing second end, said second water outlet conduit, said nozzle and said air tube is retracted within said first water outlet conduit, said second valve means opens, a portion of the water flows through said water annulus and is discharged around said second water outlet conduit and nozzle into said enclosure, and another portion of water flows through said third water outlet conduit, through said third water annulus and is discharged around said second air tube first end into said enclosure creating a venturi effect to draw ambient air through said second air tube and form a turbulent aerated stream of water and air bubbles; and when water under pressure fills said housing through said second water port, said piston is moved to a position near said housing first end, said air tube second end is in fluid communication with said air inlet, said valve means opens, said second water outlet conduit, said nozzle and said air tube is extended outwardly relative to said first water outlet conduit, said piston closes off water flow through said water annulus and through said third water outlet conduit, and water flows through said piston water passageway, through said second water annulus and is discharged around said air tube first end into said enclosure creating a venturi effect to draw ambient air through said air inlet, through said air tube and form a turbulent aerated stream of water and air bubbles.

8. An extendible and retractable air/water jet apparatus according to claim 1, further comprising a third water outlet conduit at said housing first end having a first end in fluid communication with said housing interior and a second end adapted to be connected in fluid communication with a second spa jet remote from said housing.

9. An extendible and retractable air/water jet apparatus according to claim 8, further comprising:

a second air tube having a first end disposed generally concentrically within one end of said third water outlet conduit and a second end extending outwardly of said third water outlet conduit, said air tube having an outer diameter smaller than the interior diameter of said third water outlet conduit to define a third water annulus therebetween; and second valve means connected with said second air tube for allowing passage of air only into said third air tube.

10. An extendible and retractable air/water jet apparatus according to claim 7, wherein said third water outlet conduit is formed of flexible tubing.

11. An extendible and retractable air/water jet apparatus for use in fluid containing enclosures which have at least one side wall and a pressurized water distribution system, the jet apparatus comprising:

an elongate housing having first and second ends, a hollow interior surrounded by a side wall, a first water port near said first end, and a second water port near said second end, and a first water outlet conduit connected at a first end to said housing first end in fluid communication with said housing interior;

a hollow generally cylindrical member at a second end of said first water outlet conduit adapted to be secured to the exterior of said enclosure side wall and having a central bore in fluid communication with said enclosure interior;

a piston slidably disposed within said elongate housing interior engaged in reciprocating fluid sealing relation with the interior of said housing side wall, and having a water passageway extending therethrough, said piston being movable between said housing first and second ends; and a second water outlet conduit slidably disposed inside said first water outlet conduit and connected at a first end in fluid communication with said piston water passageway;

a water discharge nozzle connected in fluid communication with a second end of said second water outlet conduit to move therewith, said second water outlet conduit having an outer diameter smaller than the interior diameter of said first water outlet conduit and said cylindrical member bore to define a first water annulus therebetween; wherein when water under pressure fills said housing through said first water port, said piston is moved to a position near said housing second end, said second water outlet conduit and nozzle is retracted within said first water outlet conduit, and water flows through said first water annulus and is discharged around said second water outlet conduit and nozzle into said enclosure; and when water under pressure fills said housing through said second water port, said piston is moved to a position near said housing first end, said second water outlet conduit and nozzle is extended outwardly relative to said first water outlet conduit, said piston closes off water flow through said first water annulus, and water flows through said piston water passageway, through the interior of said second water outlet conduit and nozzle, and is discharged into said enclosure.

12. An extendible and retractable air/water jet apparatus according to claim 11, further comprising water diverting means connected between said first and said second water ports and adapted to be connected to said water distribution system for selectively conducting water into said housing interior through either one of said first and second water ports.

13. An extendible and retractable air/water jet apparatus according to claim 11, wherein said second water outlet conduit is formed of flexible tubing.

14. An extendible and retractable air/water jet apparatus according to claim 11, wherein said first and said second water outlet conduits are formed of flexible tubing.

15. An extendible and retractable air/water jet apparatus according to claim 11, wherein said elongate housing is formed of flexible tubing.

16. An extendible and retractable air/water jet apparatus according to claim 11, further comprising:

an air inlet on said housing near its said first end for conducting air from the exterior of said housing into the interior thereof;

valve means connected with said air inlet for allowing passage of air only into said air inlet;

an air tube disposed generally concentrically within said second water outlet conduit to move therewith having a first end disposed adjacent to said nozzle and a second end extending through said piston with its interior in fluid communication with the exterior of said piston, said air tube having an outer diameter smaller than the interior diameter of said second water outlet conduit and said nozzle to define a second water annulus therebetween; wherein when water under pressure fills said housing through said first water port, said valve means closes, said piston is moved to a position near said housing second end, said second water outlet conduit, said nozzle and said air tube is retracted within said first water outlet conduit, water flows through said water annulus and is discharged around said second water outlet conduit and nozzle into said enclosure; and when water under pressure fills said housing through said second water port, said piston is moved to a position near said housing first end, said air tube second end is in fluid communication with said air inlet, said valve means opens, said second water outlet conduit, said nozzle and said air tube is extended outwardly relative to said first water outlet conduit, said piston closes off water flow through said first water annulus, and water flows through said piston water passageway, through said second water annulus and is discharged around said air tube first end into said enclosure creating a venturi effect to draw ambient air through said air inlet, through said air tube and form a turbulent aerated stream of water and air bubbles.

17. An extendible and retractable air/water jet apparatus according to claim 16, further comprising:

a second air inlet on said generally cylindrical member for conducting air from the exterior of said generally cylindrical member into the interior thereof;

second valve means connected with said second air inlet tube for allowing passage of air only into said second air tube; wherein air is drawn through said second air inlet when water flows through said first water annulus and is discharged around said second water outlet conduit and nozzle into said enclosure to form a turbulent aerated stream of water and air bubbles.

18. An extendible and retractable air/water jet apparatus according to claim 11, further comprising:

a first isolated air tube air tube disposed generally concentrically within said elongate housing having one end extending outwardly from said housing second end and a second end extending a distance inwardly from said housing second end;

a second air tube disposed generally concentrically within said second water outlet conduit to move therewith having a first end disposed adjacent to said nozzle and a second end extending through said piston with its interior slidably received on said first air tube second end in fluid sealing relation and having an interior in fluid communication with the interior of said first air tube, said second air tube having an outer diameter smaller than the interior diameter of said second water outlet conduit and said nozzle to define a second water annulus therebetween; wherein when water under pressure fills said housing through said first water port, said valve means closes, said piston is moved to a position near said housing second end, said second water outlet conduit, said nozzle and said second air tube is retracted within said first water outlet conduit, water flows through said water annulus and is discharged around said second water outlet conduit and nozzle into said enclosure; and when water under pressure fills said housing through said second water port, said piston is moved to a position near said housing first end, said second water outlet conduit, said nozzle and said second air tube is extended outwardly relative to said first water outlet conduit, said piston closes off water flow through said first water annulus, and water flows through said piston water passageway, through said second water annulus and is discharged around said second air tube first end into said enclosure creating a venturi effect to draw ambient air through said fist and second air tubes and form a turbulent aerated stream of water and air bubbles.

* * * * *